US007854184B1

(12) United States Patent
Colechia

(10) Patent No.: US 7,854,184 B1
(45) Date of Patent: Dec. 21, 2010

(54) QUICK-RELEASE DEVICE FOR UMBILICAL

(75) Inventor: Glen E. Colechia, North Stonington, CT (US)

(73) Assignee: Jan-Narik Enterprises, Las Vegas, NV (US)

( * ) Notice: Subject to any disclaimer, the term of this patent is extended or adjusted under 35 U.S.C. 154(b) by 245 days.

(21) Appl. No.: 12/323,674

(22) Filed: Nov. 26, 2008

Related U.S. Application Data

(60) Provisional application No. 60/990,316, filed on Nov. 27, 2007.

(51) Int. Cl.
*B25B 7/00* (2006.01)

(52) U.S. Cl. ..... 81/300

(58) Field of Classification Search ..... 81/300, 81/176.2; 29/235, 237; 137/315.41, 327, 137/798; 251/146, 148; 285/322; 439/190–192, 439/195

See application file for complete search history.

(56) References Cited

U.S. PATENT DOCUMENTS 5,671,777 A * 9/1997 Allen et al. ..... 137/614.06
7,143,625 B2 * 12/2006 Edin ..... 72/402

* cited by examiner

*Primary Examiner*—David B Thomas
(74) *Attorney, Agent, or Firm*—Barlow, Josephs & Holmes, Ltd.

(57) ABSTRACT

The present invention is a quick-release device for engaging an umbilical. The device includes a coupling base and arms. The coupling base has a top surface and a bottom surface. The bottom surface of the coupling base is configured for attachment to a valve known in the prior art which is used within rescue chambers. The first arm is pivotally connected with the top surface of the coupling base. The second arm is pivotally connected with the top surface of the base. Each arm defines anterior portions to enagage the umbilical. The first arm and second arm are configured to move relative to one another to engage or disengage the umbilical. In operation, a user moves the first and second arms towards one another to engage the umbilical in fluid connection to the valve. To disengage the umbilical from the fluid connection with the valve, the user releases the spring-biased arms.

9 Claims, 8 Drawing Sheets

QUICK-RELEASE DEVICE FOR UMBILICAL

CROSS REFERENCE TO RELATED APPLICATION

This application is related to and claims priority from earlier filed provisional patent application Ser. No. 60/990,316, filed Nov. 27, 2007 and incorporated herein by reference.

BACKGROUND OF THE INVENTION

The present invention relates generally to vessel escape systems, and in particular, submarine escape systems. More specifically, the present invention is a quick-release device for engaging an umbilical of an underwater escape suit, also known as a SEIE suit. The quick-release device is used with prior art valves located within a rescue chamber of a vessel to provide a quick release fluid connection between the valve and the umbilical to provide maximum stability and safety to a user.

In submarine escape systems, there is a need for a safe and effective way to deliver air into a user's suit for quick ascension out of a rescue chamber of a submarine. Most underwater escape suits, such as the SEIE (Submarine Escape Immersion Equipment), and are designed to enable a free ascent from a stricken submarine and to provide protection for the submariner on reaching the surface. The SEIE is comprised of a submarine escape and immersion suit, an inner thermal liner, and a gas inflated single seat life raft. The suit provides sufficient lifting force and breathable air to take the escapee from the submarine to the surface at a safe speed of approximately two to three meters per second.

To use the SEIE suit, users have to put on the suit and go into the rescue chamber on the submarine. Once in the chamber, the user, using one hand, engages his umbilical or flexible tube from the SEIE suit to a valve for air while using a second hand to grasp a handle within the chamber to maintain his stability. The air fills the suit to provide positive buoyancy to the user for exiting the rescue chamber. Then the chamber is flooded, which takes about 90 seconds at 600 feet. When the water pressure in the chamber is equal to the water pressure on the outside, the outer door to the chamber opens and the user shoots to the surface because of the buoyancy of the suit.

A significant problem occurs during the filling of the SEIE suit with air. When the SEIE suit is filled with air, it provides buoyancy to the user inside the chamber and before the outer door is opened for exiting the submarine. As a result, the user may drift away and loose his umbilical connection with the valve before completely filing the SEIE suit with air. Without sufficient air inside the suit, the user may not have sufficient buoyancy to travel hundreds of feet of water in the time necessary.

Furthermore, if the umbilical were connected permanently to the valve, the user would have to manually release the umbilical. The user may not have sufficient stamina or proper conditions within the rescue chamber to manually release the umbilical from the valve. As a result, if the umbilical were permanently connected, the user may not properly exit the rescue chamber and will become tethered to a possibly sinking submarine.

To optimize stability and safety within the rescue chamber, it would require the user's use of both hands to hold his balance while the rescue chamber is completely flooded. Otherwise, without proper stability, the user may drift away from the valve before completely filling the SEIE suit with air. In addition, the connection of the umbilical to the valve must allow the user the ability to quickly release or disengage from the valve to prevent from being tethered to the valve inside the rescue chamber when the outer door opens.

There have been attempts in the prior art to prevent the user from being permanently connected by an umbilical to the valve inside the rescue chamber. However, the coupling mechanisms of the prior art for connecting the umbilical to the valve for air involve the use of at least one hand to engage the umbilical in connection with the valve for air. The coupling mechanism results in a user who is not stable during the filling of the SEIE suit. As a result, the user may not have a properly inflated suit when exiting the chamber.

Therefore, there is a need for a device which will allow the user to maximize his stability by using two hands, not just one, to grasp the interior of the rescue chamber during the filling of his SEIE suit with air. In addition, there is a need for a device that will provide a quick, temporary connection between the umbilical and the valve that can be rapidly disengaged.

BRIEF SUMMARY OF THE INVENTION

The present invention preserves the advantages of prior art for quick-release devices for umbilicals. In addition, it provides new advantages not found in currently available quick-release devices for umbilicals and overcomes many disadvantages of such currently available quick-release devices for umbilicals.

The present invention relates generally to vessel escape systems, and in particular, submarine escape systems. More specifically, the present invention is a quick-release device for engaging an umbilical of an underwater escape suit, also known as a SEIE suit. The quick-release device is used with prior art valves located within a rescue chamber of a vessel to provide a quick release fluid connection between the valve and the umbilical to provide maximum stability and safety to a user.

The quick-release device includes a coupling base and a pair of arms. The coupling base has a top surface and a bottom surface. The coupling base is configured for attachment to a valve known in the prior art. In one embodiment, a coupling base defines a cylindrical shape. Also, the coupling base includes locking pins for attaching the coupling base to the valve. A handle is attached to or integrally formed with the coupling base to provide stability to a user.

The first arm is pivotally connected with the top surface of the coupling base. The second arm is pivotally connected with the top surface of the base. Each arm defines anterior portions to enagage the umbilical. The first arm and second arm are configured to move relative to one another to engage or disengage the umbilical. A handle pin is secured within the handle to provide a spacer between the first arm and second arm. A spring engaging the first and second arm is used to provide spring-bias of the arms relative to one another.

A pivot pin extends through the first arm and second arm and secured within the handle or coupling base. The pivot pin facilitates the pivotal movement of the first arm relative to the second arm. The pivot pin may contain a cap to keep the first arm and second arm engaged to the top surface of the handle or the coupling base.

In operation a user moves the first and second arms toward one another to engage the umbilical in fluid connection to the valve. To disengage the umbilical from the fluid connection with the valve, the user moves the first and second arms away from one another.

It is therefore an object of the present invention to provide a quick-release device that is reliable and durable for engaging and disengaging an umbilical in fluid connection with a valve.

It is a further object of the present invention to provide a quick-release device that provides a safe method for engaging and disengaging an umbilical in fluid connection with a valve to allow a user to quickly exist a rescue chamber.

Another object of the present invention is to provide a quick-release device that provides stability to a user when inside a rescue chamber.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the improved quick-release device are set forth in the appended claims. However, the quick-release device, together with further embodiments and attendant advantages, will be best understood by reference to the following detailed description taken in connection with the accompanying drawings in which:

DETAILED DESCRIPTION OF THE PREFERRED EMBODIMENTS

In accordance with the present invention, as shown in FIGS. 1-3 and 5-8, a new quick-release device 10 for engaging an umbilical 300 is provided. The quick-release device 10 is configured for engaging an umbilical 300 or flexible tube of an underwater escape suit (not shown), also known as a SEIE suit, and attachment to a valve 400 (FIG. 4) known in the prior art. The quick-release device 10 is used within a rescue chamber of a vessel to provide a fluid connection between the valve 400 and the umbilical 300 while concurrently providing maximum stability and safety to a user.

Most importantly, the quick-release device 10 enables a safe and effective way for users to fill their SEIE suits while inside the rescue chamber of a submarine. The quick-release device 10 allows the user to maximize his stability within the rescue chamber by freeing up two hands to grasp an interior portion of the rescue chamber during the filling of his SEIE suit with air. In addition, the present invention provides a quick, temporary fluid connection between the umbilical 300 and the valve 400 that can be rapidly disengaged for a quick exit out of the rescue chamber by the user.

Figure 1:
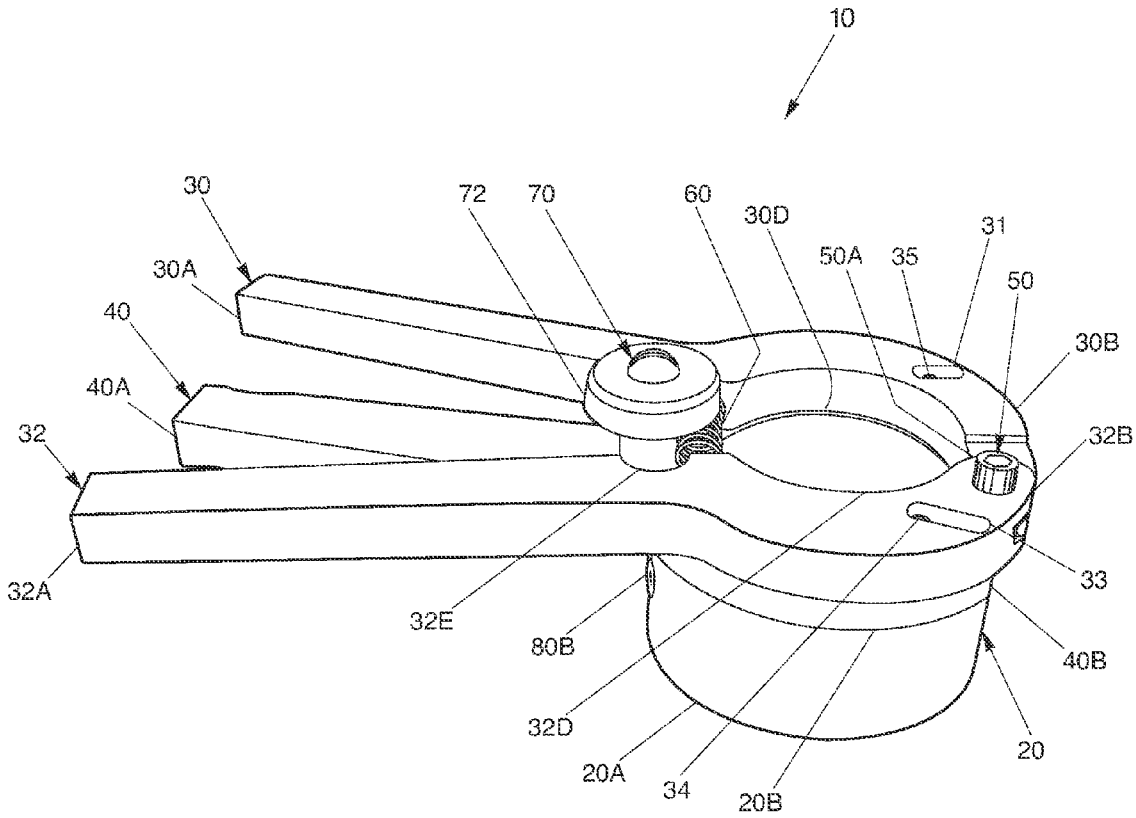
FIG. 1 is a perspective view of the quick-release device.
Figure 4:
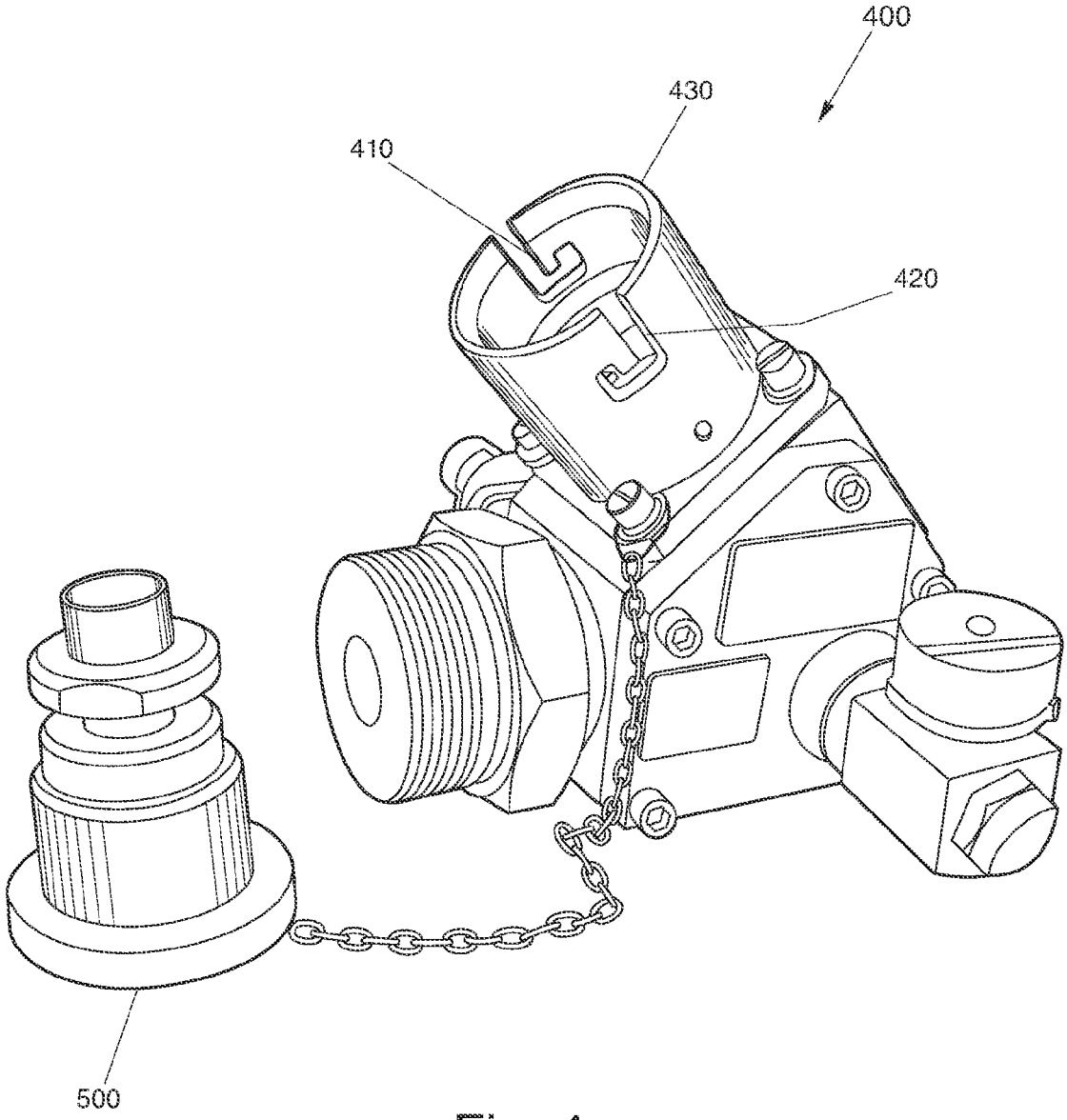
Fig. 4 Prior Art
FIG. 4 is a perspective view of a prior art valve with a cap removed.

Referring to FIG. 1, the quick-release device 10 includes a coupling base 20, a first arm 30, a second arm 32, and a handle 40. The coupling base 20 has a top surface 20B, a bottom surface 20A and a wall 20C depending between the top 20B and bottom surface 20A. The bottom surface 20A is configured for releasable engagement with a valve 400 (FIG. 4) known in the prior art which is attached to a rescue chamber. As shown in FIG. 4, the valve 400 may be manufactured by Hale Hamilton which is specifically designed for use in world-class submarines or any other manufacturer or designer of valves. Note, the present invention is not limited for usage with the valve 400 of FIG. 4 and may be adapted and configured for attachment for any valve can utilize a quick-release connection. In one embodiment, the coupling base 20 defines a cylindrical shape but may be designed with any shape suitable for releasably engaging the valve 400.

To secure the coupling base 20 to the valve 400, the coupling base 20 includes locking pins 80A, 80B for interlocking engagement within the valve 400. At least two pins 80A, 80B protrude transversally from an inner surface of the wall 20C of the coupling base 20. The pins 80A, 80B should have sufficient length for interlocking or seating within L-shaped grooves 410, 420 defined within the valve 400. Once the pins 80A, 80B are interlocked within the valve 400, a latch pin 90 is engaged to secure the coupling base 20 to the valve 400. The latch pin 90 extends through the wall 20C of the coupling base 20 and protrudes transversely from an outer surface of the wall 20C for manipulation by a user.

Figure 2:
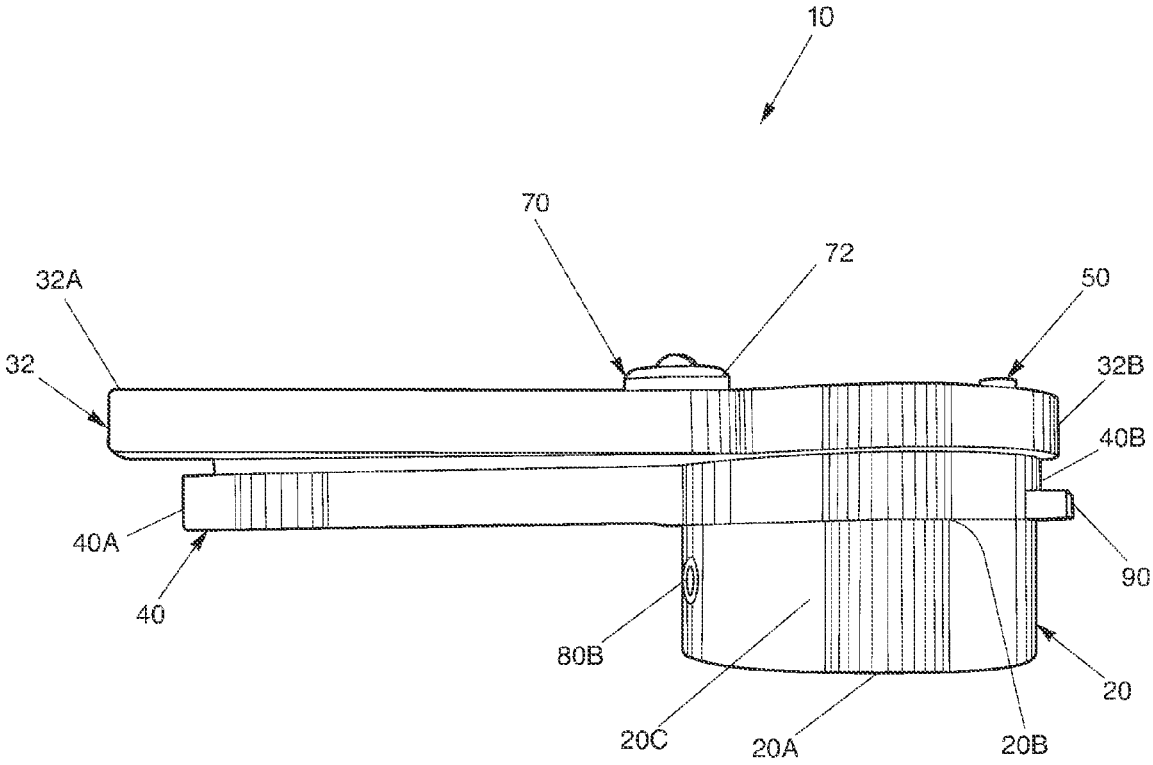
FIG. 2 is a side view of the present invention of FIG. 1.

Referring to FIG. 2, the handle 40 is either attached to or integrally formed with the coupling base 20 to provide added stability to a user. The first end 40B of the handle 40 defines a cylindrical shape, or shape similar to the coupling base 20, and the second end 40A extends in a transverse direction relative to the coupling base 20. The handle 40 provides an additional support to a user when water floods into the rescue chamber. It should be noted the present invention may operate with or without a handle 40.

Figure 3:
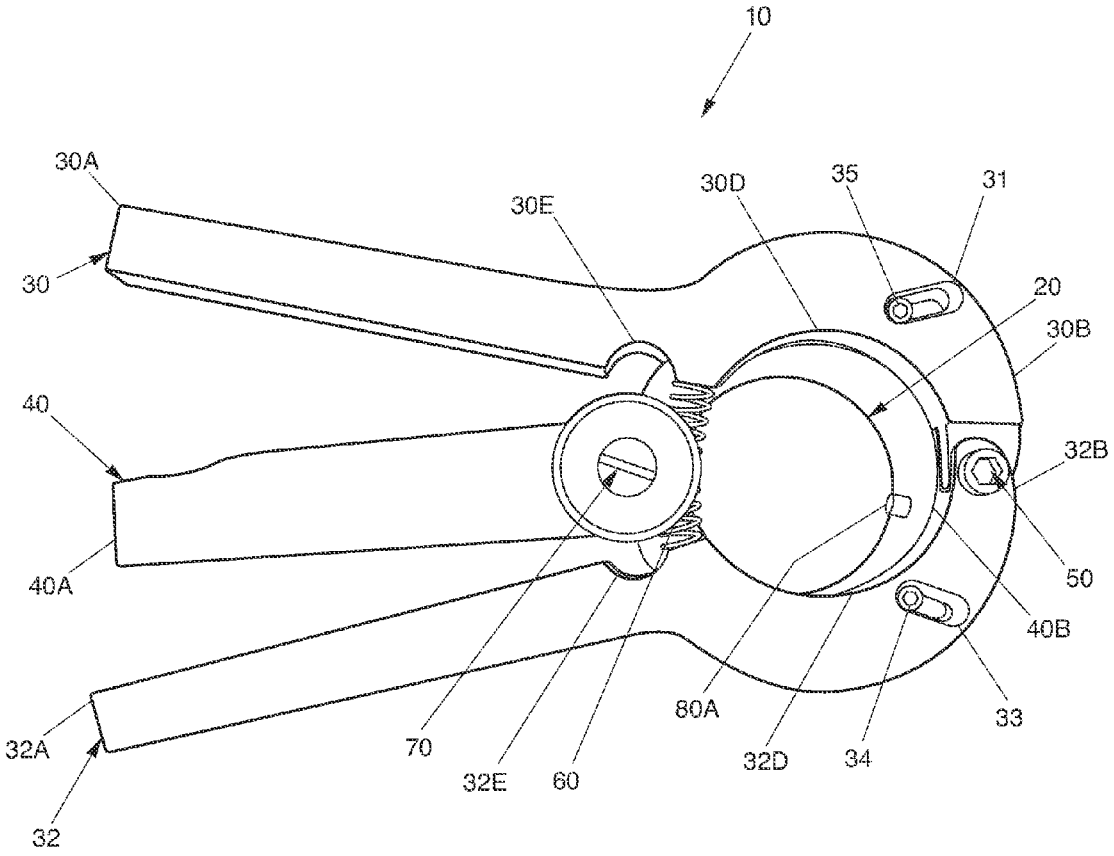
FIG. 3 is a top view of the present invention of FIG. 1.

Referring to FIG. 3, the first arm 30 is pivotally connected to the top surface 20B of the coupling base 20, first end 40B of the handle 40, or both. The first arm 30 extends in a transverse direction relative to the coupling base 20 from a first end 30A to an opposite second end 30B. The first arm 30 defines a slot 31 for slidable engagement with a first guide pin 35 attached to the handle 40 or coupling base 20. In one embodiment, the first arm 30 may include a gripping material or finger indents to facilitate the gripping of the first arm 30 by a user.

The second arm 32 is also pivotally connected to the top surface 20B of the coupling base 20, first end 40B of the handle 40, or both. Generally, the second arm 32 is a substantial mirror image of the first arm 30, which together facilitate the gripping of an umbilical 300 by a user. The second arm 32 extends in a transverse direction relative to the coupling base 20 from a first end 32A to an opposite second end 32B. The second arm 32 defines a slot 33 for slidable engagement with a second guide pin 34 attached to the handle 40 or coupling base 20. In one embodiment, the second arm 32 may include a gripping material or finger indents to facilitate the gripping of the second arm 32 by a user.

Figure 6:
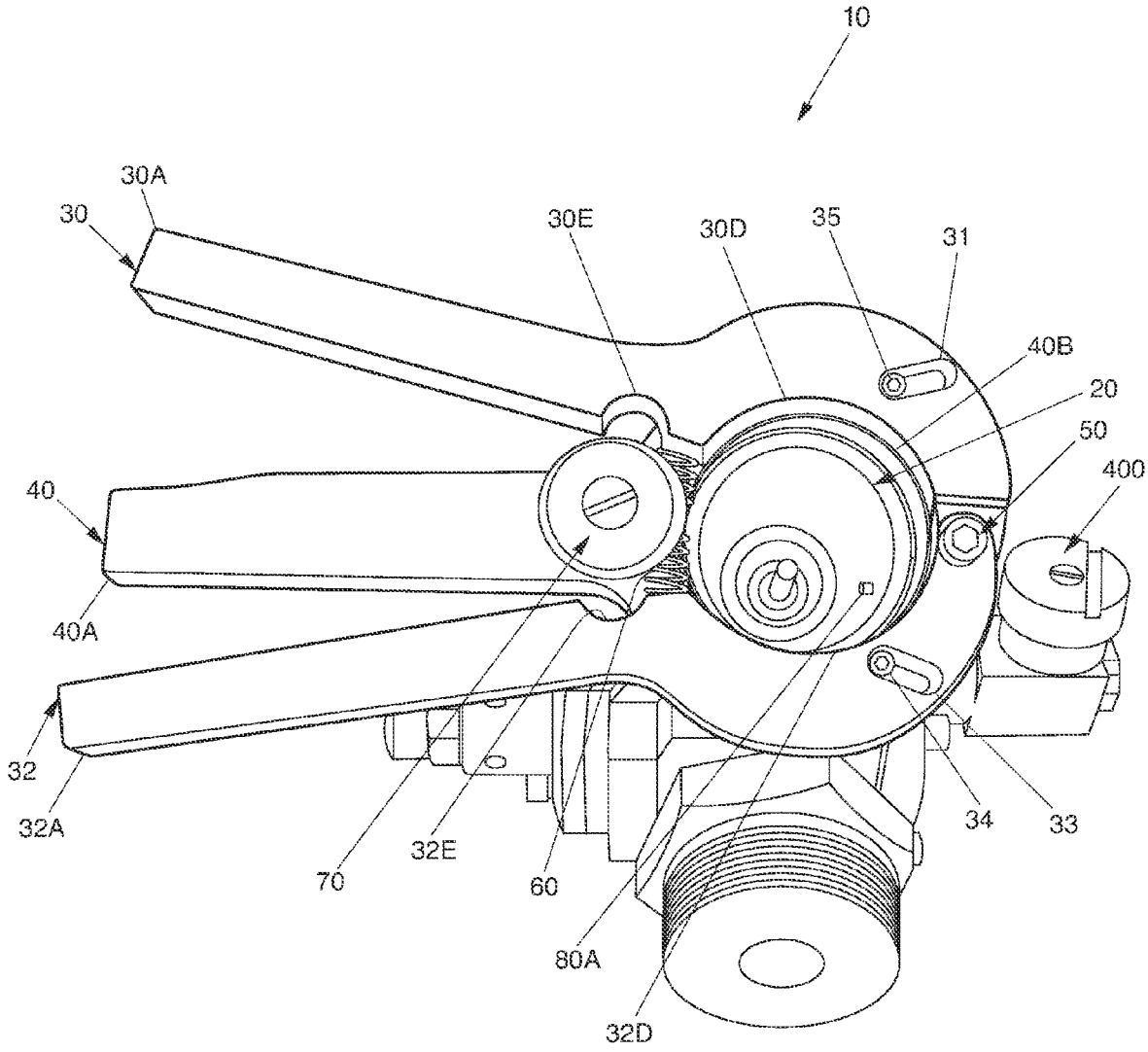
FIG. 6 is a top elevational view of the present invention of FIG. 1 attached to the prior art valve of FIG. 4.
Figure 8:
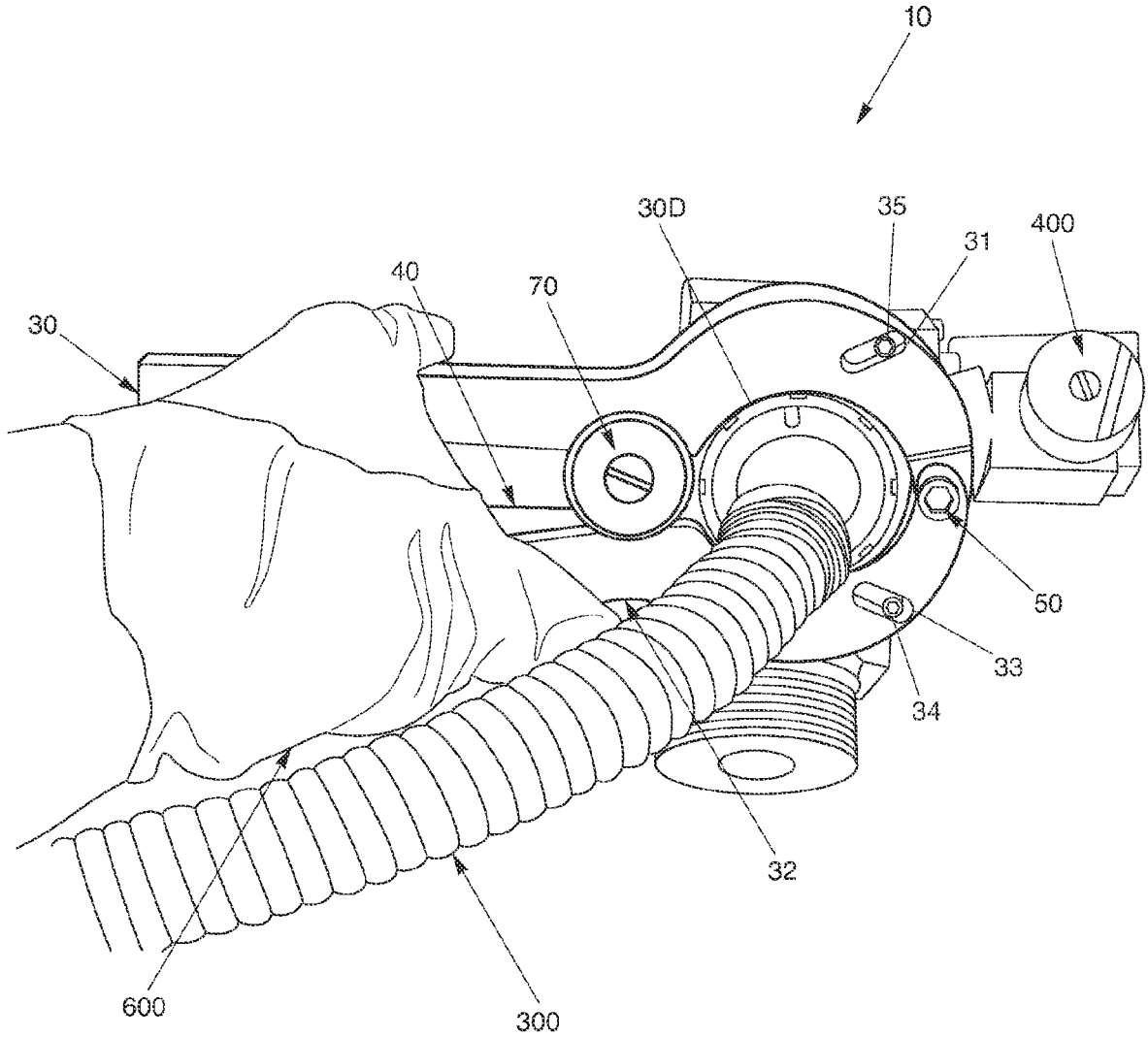
FIG. 8 is a top elevational view of the present invention of FIG. 1 attached to the prior art valve of FIG. 4 with umbilical inserted within the quick release-device.

The first arm 30 and second arm 32 are configured to move relative to one another to engage or disengage the umbilical 300 or flexible tube. As illustrated in FIG. 6, the second end 30B of the first arm 30 and the second end 32B of the second arm 32 are configured with interlocking portions 30C, 32C to facilitate movement of the first arm 30 relative to the second arm 32. A pivot pin 50 is perpendicularly extended through the interlocking portions 30C, 32C and secured within the handle 40, coupling base 20, or both. The pivot pin 50 facilitates the pivotal movement of the first arm 30 relative to the second arm 32 from a substantially open position (FIG. 1) to a substantially closed position (FIG. 8). In one embodiment, the pivot pin 50 may contain a cap 50A to keep the first arm 30 and the second arm 32 engaged to the handle 40 or the coupling base 20.

Referring to FIG. 3, both the first arm 30 and the second arm 32 define anterior portions 30D, 32D to engage the umbilical 300. Each arm 30, 32 defines the anterior portions 30D, 32D near the pivot pin 50 for engaging or gripping an umbilical 300. The anterior portion 30D, 32D defines a shape similar to the coupling base 20 or cylindrical. In one embodiment, the anterior portions 30D, 32D may have a lining made of material suitable for facilitating the gripping of the umbilical 300 by the arms 30, 32.

To facilitate the pivotal movement of the first arm 30 relative to the second arm 32, both arms 30, 32 are spring-biased relative to one another. To provide spring-bias, a spring 60 is engaged between the first arm 30 and the second arm 32. In one embodiment, the spring 60 is positioned within a middle portion of the respective arms 30, 32 where the cylindrical portion of the arms 30, 32 meets the lateral portions of the arms 30, 32. The spring 60 may be attached to the first arm 30 and second arm 32 to provide stability to the spring 60 during pivotal movement of the first arm 30 and second arm 32. Alternatively, the middle portions of the arms 30, 32 may define grooves or notches for seating the spring 60 and a handle pin 70 may be positioned proximal to the spring 60 to prevent movement thereof.

The handle pin 70 is secured within the handle 40, coupling base 20, or both to provide a spacer between the first arm 30 and second arm 32. The handle pin 70 is perpendicularly secured within the handle 40, coupling base 20, or both by means known in the art. When the arms 30, 32 are pivotally moved to a substantially closed position (FIG. 8), the handle pin 70 engages recessed grooves 30E, 32E defined within the arms 30, 32. Also, the handle pin 70 may contain a handle pin cap 72 to prevent movement of the arms 30, 32. By including the handle pin 70 within the device 10, a user may be prevented from jamming his hand or fingers between the arms 30, 32. In addition, the handle pin 70 prevents the arms 30, 32 from completely engaging one another which restricts an amount of pressure applied by the user to the umbilical 300 and thereby preserving the integrity of the umbilical 300. Alternatively, the handle pin 70 may be not included within the quick-release device 10.

Figure 5:
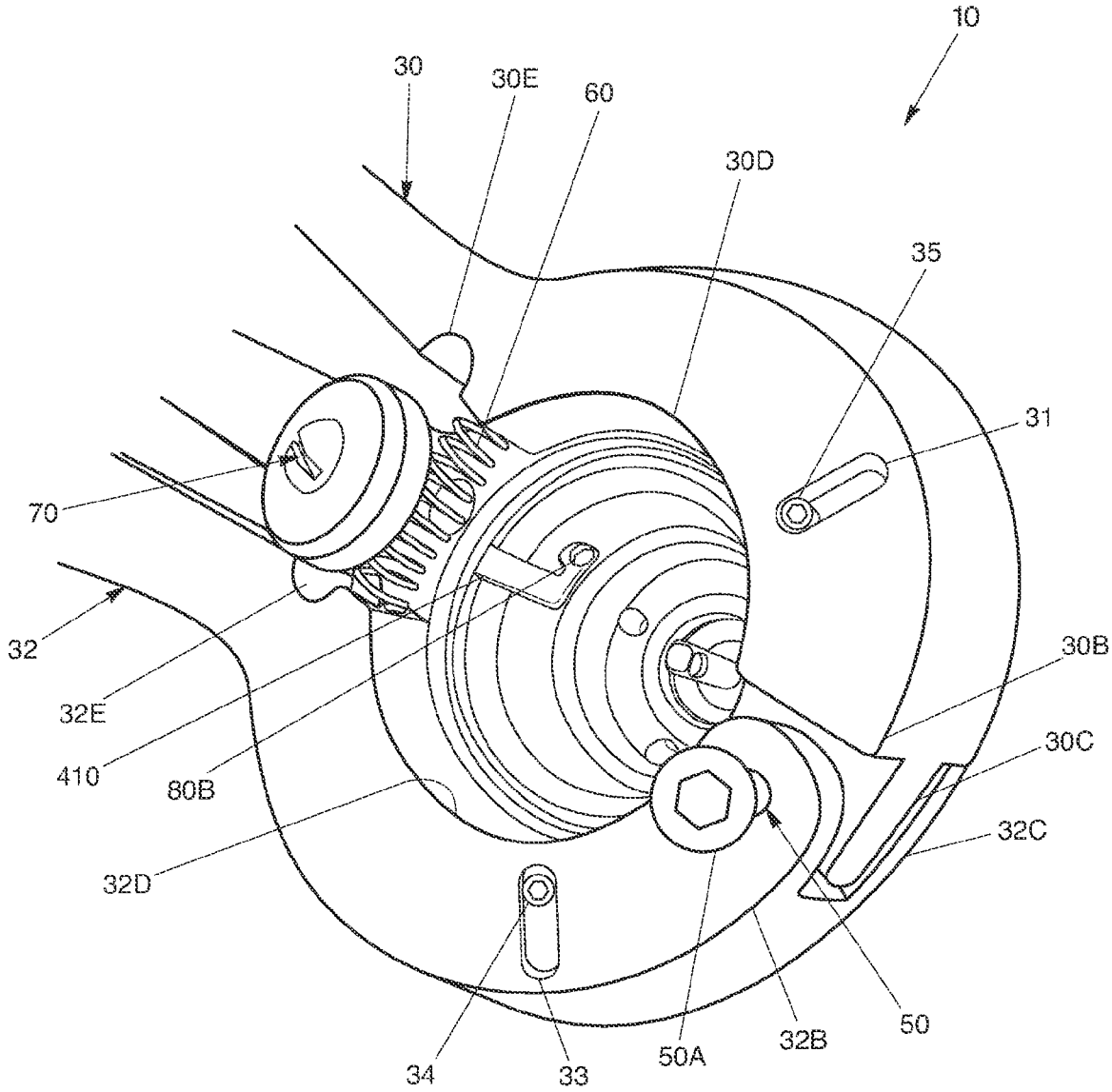
FIG. 5 is a front elevational view of the present invention of FIG. 1 attached to the prior art valve of FIG. 4.

As illustrated in FIG. 4, the prior art valve 400 includes an interlocked cap 500 which is removed before attaching the quick-release device 10 of the present invention. In operation, once the cap 500 is removed, the quick-release device 10 is interlockingly engaged with the valve head 430 where the cap 500 once resided. Referring to FIG. 5, the locking pins 80A, 80B of the coupling base 20 are slotted within the L-shaped grooves 410, 420 of the valve 400 for releasably securing the quick-release device 10 to the valve 400. The latch pin 90 is engaged to lock the quick-release device 10 to the valve 400. Note, the quick-release device 10 of the present invention may use a variety of mechanisms known in the prior art for releasably attaching the device 10 to the valve 400.

Figure 7:
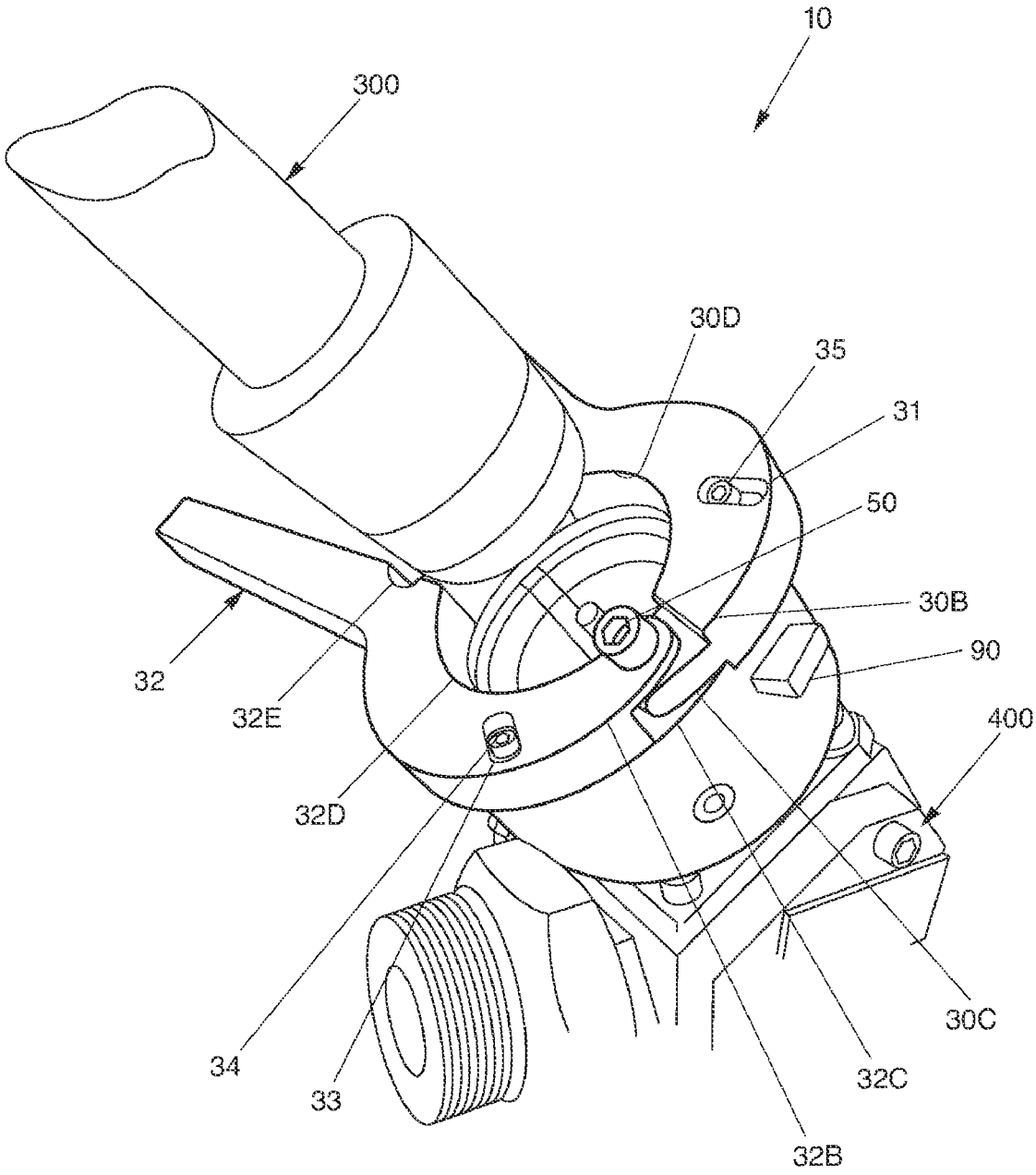
FIG. 7 is a front perspective view of the present invention of FIG. 1 attached to the prior art valve of FIG. 4.

Referring to FIG. 6, once the quick-release device 10 is secured to the valve 400, the arms 30, 32 are spring-biased in a substantially open position for receipt of the umbilical 300. Referring to FIG. 7, the user then positions the umbilical 300 within the quick-release device 10. In one embodiment, the umbilical 300 is positioned within the anterior portions 30D, 32D of the arms 30, 32 to fluidly connect with the valve 400 positioned behind the quick-release device 10. Referring to FIG. 8, once the umbilical 300 is positioned within the quick-release device 10, a user 600 moves or squeezes the first arm 30 and second arm 32 towards one another, tending to bring them closer together, so that, under the effect of the force, the umbilical 300 is gripped to maintain the umbilical 300 in fluid connection with the valve 400. The quick-release device 10 is particularly interesting in that, once the umbilical 300 is positioned within the anterior portions 30D, 32D of the arms 30, 32, the device 10 conserves the position of the umbilical 300 without further sliding.

Concurrently, a user, by gripping the quick-release device 10 is provided added stability during the flooding of the rescue chamber (not shown) with water. By using the quick-release device 10, the user may use two hands and not just one for stability. Since the quick-release device 10 is attached to the valve 400, and the valve 400 is attached to the rescue chamber (not shown), the user is given additional stability by freeing up both hands to essentially grasp the interior of the rescue chamber. For example, the user may use one hand to grasp the first and second arms 30, 32 together to engage the umbilical 300 within the valve 400 while, at the same time, using the other hand to hold the handle 40 of the quick-release device 10 or possibly another handle or portion of the rescue chamber. Thus, the user is using both hands for stability during the filling of his SEIE suit with air.

To fluidly disengage the umbilical 300 from the valve 400, the user releases the spring-biased arms 30, 32 to move away from one another. Once the force upon the arms 30, 32 is removed, the first and second arms 30, 32 release the gripping force on the umbilical 300 which allows the umbilical 300 to eventually fluidly disengage from the valve 400. By providing a quick-release device 10 between the valve 400 and umbilical 300, the user is provided a quick-release connection between the valve 400 and umbilical 300 which can be quickly disengaged prior to exiting the rescue chamber (not shown).

It should be noted that the device 10 may be used for purposes other than engaging or disengaging an umbilical for a SEIE suit. The device 10 may be used to quickly engage or disengage a hose, tube, or cord which facilitates delivery of a variety of fluids. The tube may be a hollow, cylindrical body made of any material used for conveying or containing fluids, liquids, or gases. Also, the device 10 may be releasably attached to any device, not just a valve 400, for halting or controlling the flow of a liquid, gas, or other material through a passage, pipe, inlet, or outlet.

In view of the foregoing, the present invention provides a new and unique quick-release device 10 for an umbilical 300. The quick-release device 10 addresses issues associated with the prior art whereby a user must use one hand to maintain the connection between the umbilical 300 and the valve 400 without providing any stability to the user. The quick-release device 10 of the present invention will allow the user to maximize his stability by allowing the user to use both hands for stability during the filling of an underwater escape suit with air while inside the rescue chamber. In addition, the quick-release device 10 provides added safety by providing a connection between the valve 400 and the umbilical 300 which can be quickly disengaged before exiting a rescue chamber.

Therefore, while there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for engaging a tube, comprising:

a coupling base having a top surface and a bottom surface, the bottom surface configured for releasable engagement to a means for controlling flow of a fluid;

a first arm pivotally connected with the top surface of the base;

a second arm pivotally connected with the top surface of the base, the first arm and second arm configured to pivotally move relative to one another to engage or disengage the tube in fluid connection with the means for controlling the flow of a fluid; and wherein a user moves the first and second arms towards one another to engage the tube in fluid connection to the means for controlling flow of a fluid.

2. The device of claim 1, wherein the coupling base is configured for attachment to a valve inside a rescue chamber.

3. The device of claim 1, wherein the coupling base defines a cylindrical shape.

4. The device of claim 1, further comprising:

a pivot pin perpendicularly extending through the first arm and second arm to facilitate pivotal movement of the first arm relative to the second arm.

5. The device of claim 1, further comprising:

a handle attached or integrally formed with the coupling base to provide stability to a user.

6. The device of claim 1, wherein the coupling base includes locking pins for attaching the coupling base to the valve.

7. The device of claim 5, further comprising:

a handle pin secured within the handle to provide a spacer between the first arm and second arm.

8. The device of claim 1, further comprising:

a spring providing spring-bias to the first and second arms relative to one another.

9. A device connected to a valve used in rescue chambers for engaging an umbilical, comprising:

a coupling base defining a cylindrical shape, the coupling base having a top surface and a bottom surface, the coupling base including locking pins for attaching the coupling base to the valve;

a handle attached to or integrally formed with the coupling base to provide stability to a user;

a first arm pivotally connected with the top surface of the handle;

a second arm pivotally connected with the top surface of the handle, each arm defining anterior portions to enagage the umbilical; the first arm and second arm configured to move relative to one another to engage or disengage the umbilical;

a spring engaging the first and second arm to provide spring-bias of the arms relative to one another;

a pivot pin extending through the first arm and second arm and secured within the handle to facilitate the pivotal movement of the first arm relative to the second arm;

a handle pin secured within the handle to provide a spacer between the first arm and second arm; and wherein a user moves the first and second arms towards one another to engage the umbilical in fluid connection to the valve, and wherein the user releases the spring-biased arms to allow the umbilical to disengage from the fluid connection with the valve.

* * * * *